US010653291B2

(12) United States Patent
Fountain et al.

(10) Patent No.: US 10,653,291 B2
(45) Date of Patent: May 19, 2020

(54) ULTRA MICRON FILTER FOR A DISHWASHER

(71) Applicant: Whirlpool Corporation, Benton Harbor, MI (US)

(72) Inventors: Jordan R. Fountain, St. Joseph, MI (US); Antony M. Rappette, Benton Harbor, MI (US); Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 183 days.

(21) Appl. No.: 15/582,854

(22) Filed: May 1, 2017

(65) Prior Publication Data

US 2017/0231462 A1 Aug. 17, 2017

Related U.S. Application Data

(60) Continuation of application No. 15/479,590, filed on Apr. 5, 2017, which is a division of application No. 13/164,298, filed on Jun. 20, 2011, now abandoned.

(51) Int. Cl.
*A47L 15/42* (2006.01)
*A47L 15/46* (2006.01)
(Continued)

(52) U.S. Cl.
CPC ..... *A47L 15/4202* (2013.01); *A47L 15/0005* (2013.01); *A47L 15/0007* (2013.01);
(Continued)

(58) Field of Classification Search
CPC ..... A47L 15/4219; A47L 15/0005; A47L 15/0007; A47L 15/22; A47L 15/4202;
(Continued)

(56) References Cited

U.S. PATENT DOCUMENTS 1,617,021 A 2/1927 Mitchell
2,044,524 A 6/1936 Caise
(Continued)

FOREIGN PATENT DOCUMENTS

CH 169630 6/1934
CN 2571812 9/2003
(Continued)

OTHER PUBLICATIONS

Machine translation of DE102007060195 (Year: 2009).*
(Continued)

*Primary Examiner* — Douglas Lee
(74) *Attorney, Agent, or Firm* — McGarry Bair PC

(57) ABSTRACT

A dishwasher for treating utensils in the dishwasher wherein the dishwasher has a tub at least partially defining a treating chamber, a liquid spray system, a liquid recirculation system fluidly coupling the treating chamber to the spray system to recirculate wash liquid from the treating chamber to the spray system, and filters capable of removing particles from the wash liquid and a method including spraying the wash liquid, recirculating the sprayed wash liquid, microfiltering, and ultrafiltering at least a portion of wash liquid.

9 Claims, 4 Drawing Sheets

(51) Int. Cl.
*A47L 15/00* (2006.01)
*A47L 15/22* (2006.01)

(52) U.S. Cl.
CPC ..... *A47L 15/22* (2013.01); *A47L 15/4219* (2013.01); *A47L 15/4285* (2013.01); *A47L 15/4293* (2013.01); *A47L 15/46* (2013.01)

(58) Field of Classification Search
CPC .. A47L 15/4285; A47L 15/4293; A47L 15/46; A47L 15/4206
See application file for complete search history.

(56) References Cited

U.S. PATENT DOCUMENTS 2,154,559 A 4/1939 Bilde
2,422,022 A 6/1947 Koertge
2,726,666 A 12/1955 Oxford
2,734,122 A 2/1956 Flannery
3,016,147 A 1/1962 Cobb et al.
3,026,628 A 3/1962 Berger, Sr. et al.
3,064,664 A 11/1962 Warhus
3,068,877 A 12/1962 Jacobs
3,103,227 A 9/1963 Long
3,122,148 A * 2/1964 Alabaster ..... A47L 15/16 134/56 D
3,186,417 A 6/1965 Fay
3,288,154 A 11/1966 Jacobs
3,310,243 A 3/1967 Duncan et al.
3,378,933 A 4/1968 Jenkins
3,542,594 A 11/1970 Smith et al.
3,575,185 A 4/1971 Barbulesco
3,586,011 A 6/1971 Mazza
3,708,120 A 1/1973 Camprubi et al.
3,709,236 A 1/1973 Field et al.
3,739,145 A 6/1973 Woehler
3,801,280 A 4/1974 Shah et al.
3,846,321 A 11/1974 Strange
3,906,967 A 9/1975 Bergeson
3,989,054 A 11/1976 Mercer
4,179,307 A 12/1979 Cau et al.
4,180,095 A 12/1979 Woolley et al.
4,228,962 A 10/1980 Dingler et al.
4,326,552 A 4/1982 Bleckmann
4,346,723 A 8/1982 Geiger
4,359,250 A 11/1982 Jenkins
4,374,443 A 2/1983 Mosell
4,528,097 A 7/1985 Ward
4,754,770 A 7/1988 Fornasari
5,002,890 A 3/1991 Morrison
5,030,357 A 7/1991 Lowe
5,131,419 A 7/1992 Roberts
5,133,863 A 7/1992 Zander
5,331,986 A 7/1994 Lim et al.
5,427,129 A 6/1995 Young, Jr. et al.
5,454,298 A 10/1995 Lu
5,470,142 A 11/1995 Sargeant et al.
5,470,472 A 11/1995 Baird et al.
5,546,968 A 8/1996 Jeon et al.
5,557,704 A 9/1996 Dennis et al.
5,569,383 A 10/1996 Vander Ark, Jr. et al.
5,601,100 A 2/1997 Kawakami et al.
5,618,424 A 4/1997 Nagaoka
5,630,437 A 5/1997 Dries et al.
5,655,556 A 8/1997 Guerrera et al.
5,673,714 A 10/1997 Campagnolo et al.
5,711,325 A 1/1998 Kloss et al.
5,755,244 A 5/1998 Sargeant et al.
5,782,112 A 7/1998 White et al.
5,803,100 A * 9/1998 Thies ..... A47L 15/4204 134/104.4
5,865,997 A 2/1999 Isaacs
5,868,937 A 2/1999 Back et al.
5,904,163 A 5/1999 Inoue et al.
5,924,432 A 7/1999 Majlessi
6,053,185 A 4/2000 Beevers
6,289,908 B1 9/2001 Kelsey
6,389,908 B1 5/2002 Chevalier et al.
6,443,091 B1 9/2002 Matte
6,460,555 B1 10/2002 Tuller et al.
6,491,049 B1 12/2002 Tuller et al.
6,601,593 B2 8/2003 Deiss et al.
6,666,976 B2 12/2003 Benenson, Jr. et al.
6,675,437 B1 1/2004 York
6,800,197 B1 10/2004 Kosola et al.
6,997,195 B2 2/2006 Durazzani et al.
7,047,986 B2 5/2006 Ertle et al.
7,069,181 B2 6/2006 Jerg et al.
7,093,604 B2 8/2006 Jung et al.
7,150,284 B2 12/2006 Aulbers et al.
7,153,817 B2 12/2006 Binder
7,198,054 B2 4/2007 Welch
7,208,080 B2 4/2007 Batten et al.
7,232,494 B2 6/2007 Rappette
7,250,174 B2 7/2007 Lee et al.
7,270,132 B2 9/2007 Inui et al.
7,319,841 B2 1/2008 Bateman, III et al.
7,326,338 B2 2/2008 Batten et al.
7,331,356 B2 2/2008 VanderRoest et al.
7,347,212 B2 3/2008 Rosenbauer
7,350,527 B2 4/2008 Gurubatham et al.
7,363,093 B2 4/2008 King et al.
7,406,843 B2 8/2008 Thies et al.
7,409,962 B2 8/2008 Welch
7,445,013 B2 11/2008 VanderRoest et al.
7,475,696 B2 1/2009 VanderRoest et al.
7,497,222 B2 3/2009 Edwards et al.
7,523,758 B2 4/2009 VanderRoest et al.
7,594,513 B2 9/2009 VanderRoest et al.
7,810,512 B2 10/2010 Pyo et al.
7,819,983 B2 10/2010 Kim et al.
7,896,977 B2 3/2011 Gillum et al.
8,038,802 B1 10/2011 Tuller
8,043,437 B1 10/2011 Delgado et al.
8,137,479 B2 3/2012 VanderRoest et al.
8,161,986 B2 4/2012 Alessandrelli
8,187,390 B2 5/2012 VanderRoest et al.
8,215,322 B2 7/2012 Fountain et al.
8,627,832 B2 1/2014 Fountain et al.
8,667,974 B2 3/2014 Fountain et al.
8,746,261 B2 6/2014 Welch
9,005,369 B2 4/2015 Delgado et al.
9,010,344 B2 4/2015 Tuller et al.
9,034,112 B2 5/2015 Tuller et al.
9,107,559 B2 8/2015 Tuller et al.
9,538,898 B2 1/2017 Tuller et al.
2002/0017483 A1 2/2002 Chesner et al.
2003/0037809 A1 2/2003 Favaro
2003/0168087 A1 9/2003 Inui et al.
2003/0205248 A1 11/2003 Christman et al.
2004/0007253 A1 1/2004 Jung et al.
2004/0103926 A1 6/2004 Ha
2004/0254654 A1 12/2004 Donnelly et al.
2005/0022849 A1 2/2005 Park et al.
2005/0133070 A1 6/2005 VanderRoest et al.
2006/0005863 A1 1/2006 Gurubatham et al.
2006/0042657 A1 3/2006 Welch
2006/0054549 A1 3/2006 Schoendorfer
2006/0123563 A1 6/2006 Raney et al.
2006/0162744 A1 7/2006 Walkden
2006/0174915 A1 8/2006 Hedstrom et al.
2006/0236556 A1 10/2006 Ferguson et al.
2006/0237049 A1* 10/2006 Weaver ..... A47L 15/4204 134/56 D
2006/0237052 A1 10/2006 Picardat et al.
2007/0006898 A1 1/2007 Lee
2007/0107753 A1 5/2007 Jerg
2007/0119478 A1 5/2007 King et al.
2007/0124004 A1 5/2007 King et al.
2007/0163626 A1 7/2007 Klein
2007/0186964 A1 8/2007 Mason et al.
2007/0246078 A1 10/2007 Purtilo et al.
2007/0266587 A1 11/2007 Bringewatt et al.
2007/0295360 A1 12/2007 Jerg et al.

(56) References Cited

U.S. PATENT DOCUMENTS

| | | | | |
|---|---|---|---|---|
| 2008/0116135 | A1* | 5/2008 | Rieger | A47L 15/4206 210/650 |
| 2008/0190464 | A1 | 8/2008 | Stahlmann et al. | |
| 2008/0245394 | A1* | 10/2008 | Doherty | A47L 15/241 134/21 |
| 2008/0289654 | A1 | 11/2008 | Kim et al. | |
| 2008/0289664 | A1 | 11/2008 | Rockwell et al. | |
| 2009/0095330 | A1 | 4/2009 | Iwanaga et al. | |
| 2009/0101182 | A1 | 4/2009 | Buesing et al. | |
| 2009/0283111 | A1 | 11/2009 | Classen et al. | |
| 2010/0012159 | A1 | 1/2010 | Verma et al. | |
| 2010/0043826 | A1 | 2/2010 | Bertsch et al. | |
| 2010/0043828 | A1 | 2/2010 | Choi et al. | |
| 2010/0043847 | A1 | 2/2010 | Yoon et al. | |
| 2010/0121497 | A1 | 5/2010 | Heisele et al. | |
| 2010/0147339 | A1 | 6/2010 | Bertsch et al. | |
| 2010/0154830 | A1 | 6/2010 | Lau et al. | |
| 2010/0154841 | A1 | 6/2010 | Fountain et al. | |
| 2010/0175762 | A1 | 7/2010 | Anacrelico | |
| 2010/0224223 | A1 | 9/2010 | Kehl et al. | |
| 2010/0252081 | A1* | 10/2010 | Classen | A47L 15/4206 134/110 |
| 2010/0300499 | A1 | 12/2010 | Han et al. | |
| 2011/0030742 | A1 | 2/2011 | Dalsing et al. | |
| 2011/0061682 | A1 | 3/2011 | Fountain et al. | |
| 2011/0120508 | A1 | 5/2011 | Yoon et al. | |
| 2011/0126865 | A1 | 6/2011 | Yoon et al. | |
| 2011/0146714 | A1 | 6/2011 | Fountain et al. | |
| 2011/0146730 | A1 | 6/2011 | Welch | |
| 2011/0146731 | A1 | 6/2011 | Fountain et al. | |
| 2011/0197933 | A1 | 8/2011 | Yoon et al. | |
| 2011/0214702 | A1 | 9/2011 | Brown-West et al. | |
| 2011/0240070 | A1 | 10/2011 | Fadler et al. | |
| 2012/0097200 | A1 | 4/2012 | Fountain | |
| 2012/0118330 | A1 | 5/2012 | Tuller et al. | |
| 2012/0118336 | A1 | 5/2012 | Welch | |
| 2012/0138096 | A1 | 6/2012 | Tuller et al. | |
| 2012/0138106 | A1 | 6/2012 | Fountain et al. | |
| 2012/0138107 | A1 | 6/2012 | Fountain et al. | |
| 2012/0167928 | A1 | 7/2012 | Fountain et al. | |
| 2012/0291805 | A1 | 11/2012 | Tuller et al. | |
| 2012/0291822 | A1 | 11/2012 | Tuller et al. | |
| 2012/0318295 | A1 | 12/2012 | Delgado et al. | |
| 2012/0318296 | A1 | 12/2012 | Fountain et al. | |
| 2012/0318308 | A1 | 12/2012 | Fountain et al. | |
| 2012/0318309 | A1 | 12/2012 | Tuller et al. | |
| 2013/0186437 | A1 | 7/2013 | Tuller et al. | |
| 2013/0186438 | A1 | 7/2013 | Fountain et al. | |
| 2013/0200386 | A1 | 8/2013 | Jozwiak | |
| 2013/0319481 | A1 | 12/2013 | Welch | |
| 2013/0319482 | A1 | 12/2013 | Vallejo Noriega et al. | |
| 2013/0319483 | A1 | 12/2013 | Welch | |
| 2013/0319485 | A1 | 12/2013 | Blanchard et al. | |
| 2014/0109938 | A1 | 4/2014 | Geda et al. | |
| 2014/0130829 | A1 | 5/2014 | Fountain et al. | |
| 2014/0230852 | A1 | 8/2014 | Tuller et al. | |
| 2014/0238446 | A1 | 8/2014 | Welch | |
| 2014/0332040 | A1 | 11/2014 | Geda | |
| 2014/0373876 | A1 | 12/2014 | Feddema | |
| 2015/0020854 | A1 | 1/2015 | Tuller et al. | |
| 2015/0265129 | A1 | 9/2015 | Welch et al. | |

FOREIGN PATENT DOCUMENTS

| | | | | |
|---|---|---|---|---|
| CN | 2761660 | | 3/2006 | |
| CN | 1966129 | | 5/2007 | |
| CN | 2907830 | | 6/2007 | |
| CN | 101406379 | | 4/2009 | |
| CN | 201276653 | | 7/2009 | |
| CN | 201316486 | | 12/2009 | |
| CN | 101654855 | | 2/2010 | |
| CN | 201410325 | | 2/2010 | |
| CN | 201473770 | | 5/2010 | |
| DE | 1134489 | | 8/1962 | |
| DE | 1428358 | A1 | 11/1968 | |
| DE | 1453070 | | 3/1969 | |
| DE | 7105474 | | 8/1971 | |
| DE | 7237309 | U | 9/1973 | |
| DE | 2825242 | A1 | 1/1979 | |
| DE | 3337369 | A1 | 4/1985 | |
| DE | 3723721 | A1 | 5/1988 | |
| DE | 3842997 | A1 | 7/1990 | |
| DE | 4011834 | | 10/1991 | |
| DE | 4016915 | A1 | 11/1991 | |
| DE | 4131914 | A1 | 4/1993 | |
| DE | 4236931 | A1 | 5/1993 | |
| DE | 9415486 | U1 | 11/1994 | |
| DE | 9416710 | U1 | 1/1995 | |
| DE | 4413432 | C1 | 8/1995 | |
| DE | 4418523 | A1 | 11/1995 | |
| DE | 4433842 | | 3/1996 | |
| DE | 69111365 | T2 | 3/1996 | |
| DE | 19546965 | A1 | 6/1997 | |
| DE | 69403957 | T2 | 1/1998 | |
| DE | 19652235 | | 6/1998 | |
| DE | 10000772 | A1 | 7/2000 | |
| DE | 69605965 | T2 | 8/2000 | |
| DE | 19951838 | A1 | 5/2001 | |
| DE | 10065571 | A1 | 7/2002 | |
| DE | 10106514 | A1 | 8/2002 | |
| DE | 60206490 | T2 | 5/2006 | |
| DE | 60302143 | | 8/2006 | |
| DE | 102005023428 | A1 | 11/2006 | |
| DE | 102005038433 | A1 | 2/2007 | |
| DE | 102007007133 | A1 | 8/2008 | |
| DE | 102007060195 | A1 * | 6/2009 | A47L 15/4202 |
| DE | 102007060195 | A1 | 6/2009 | |
| DE | 202010006739 | U1 | 9/2010 | |
| DE | 102009027910 | A1 | 1/2011 | |
| DE | 102009028278 | A1 | 2/2011 | |
| DE | 102010061215 | A1 | 6/2011 | |
| DE | 102011052846 | A1 | 5/2012 | |
| DE | 102010061346 | A1 | 6/2012 | |
| DE | 102012103435 | A1 | 12/2012 | |
| EP | 0068974 | A1 | 1/1983 | |
| EP | 0178202 | A1 | 4/1986 | |
| EP | 0198496 | A1 | 10/1986 | |
| EP | 0208900 | A2 | 1/1987 | |
| EP | 0370552 | A1 | 5/1990 | |
| EP | 0374616 | A1 | 6/1990 | |
| EP | 0383028 | A2 | 8/1990 | |
| EP | 0405627 | A1 | 1/1991 | |
| EP | 437189 | A1 | 7/1991 | |
| EP | 0454640 | A1 | 10/1991 | |
| EP | 0521815 | A1 | 1/1993 | |
| EP | 0524102 | A1 | 1/1993 | |
| EP | 0585905 | A2 | 3/1994 | |
| EP | 0597907 | A1 | 5/1994 | |
| EP | 0702928 | A1 | 8/1995 | |
| EP | 0725182 | A1 | 8/1996 | |
| EP | 0748607 | A2 | 12/1996 | |
| EP | 0752231 | A1 | 1/1997 | |
| EP | 752231 | A1 | 1/1997 | |
| EP | 0752231 | A1 * | 1/1997 | A47L 15/4206 |
| EP | 0854311 | A2 | 7/1998 | |
| EP | 0855165 | A2 | 7/1998 | |
| EP | 0898928 | A1 | 3/1999 | |
| EP | 0943281 | A2 | 9/1999 | |
| EP | 1029965 | A1 | 8/2000 | |
| EP | 1224902 | A2 | 7/2002 | |
| EP | 1256308 | A2 | 11/2002 | |
| EP | 1264570 | | 12/2002 | |
| EP | 1277430 | A1 | 1/2003 | |
| EP | 1319360 | A1 | 6/2003 | |
| EP | 1342827 | | 9/2003 | |
| EP | 1346680 | A2 | 9/2003 | |
| EP | 1386575 | A1 | 2/2004 | |
| EP | 1415587 | | 5/2004 | |
| EP | 1498065 | A1 | 1/2005 | |
| EP | 1583455 | A1 | 10/2005 | |
| EP | 1728913 | A2 | 12/2006 | |
| EP | 1743871 | A1 | 1/2007 | |
| EP | 1862104 | A1 | 12/2007 | |

(56) References Cited

FOREIGN PATENT DOCUMENTS

| | | | | |
|---|---|---|---|---|
| EP | 1882436 | A1 | 1/2008 | |
| EP | 1980193 | A1 | 10/2008 | |
| EP | 2075366 | A1 | 1/2009 | |
| EP | 2127587 | A1 | 12/2009 | |
| EP | 2138087 | A1 | 12/2009 | |
| EP | 1703834 | B1 | 2/2011 | |
| EP | 2332457 | A1 | 6/2011 | |
| EP | 2335547 | A1 | 6/2011 | |
| EP | 2338400 | A1 | 6/2011 | |
| EP | 2351507 | A1 | 8/2011 | |
| FR | 1370521 | A1 | 8/1964 | |
| FR | 2372363 | A1 | 6/1978 | |
| FR | 2491320 | A1 | 4/1982 | |
| FR | 2491321 | A1 | 4/1982 | |
| FR | 2790013 | A1 | 8/2000 | |
| GB | 1123789 | A | 8/1964 | |
| GB | 973859 | A | 10/1964 | |
| GB | 1047948 | | 11/1966 | |
| GB | 1515095 | | 6/1978 | |
| GB | 2274772 | A | 8/1994 | |
| JP | 55039215 | A | 3/1980 | |
| JP | 60069375 | A | 4/1985 | |
| JP | 61085991 | A | 5/1986 | |
| JP | 61200824 | A | 9/1986 | |
| JP | 1005521 | A2 | 1/1989 | |
| JP | 1080331 | A | 3/1989 | |
| JP | 5245094 | A | 9/1993 | |
| JP | 07178030 | | 7/1995 | |
| JP | 9164107 | A | 6/1997 | |
| JP | 10109007 | A | 4/1998 | |
| JP | 10243910 | A | 9/1998 | |
| JP | 11076127 | A | 3/1999 | |
| JP | 2000107114 | A | 4/2000 | |
| JP | 2001190479 | A | 7/2001 | |
| JP | 2001190480 | A | 7/2001 | |
| JP | 2003336909 | A | 12/2003 | |
| JP | 2003339607 | A | 12/2003 | |
| JP | 2004113683 | A | 4/2004 | |
| JP | 2004267507 | A | 9/2004 | |
| JP | 2005124979 | A | 5/2005 | |
| JP | 2006075635 | A | 3/2006 | |
| JP | 2007068601 | A | 3/2007 | |
| JP | 2008093196 | A | 4/2008 | |
| JP | 2008253543 | A | 10/2008 | |
| JP | 2008264018 | A | 11/2008 | |
| JP | 2008264724 | A | 11/2008 | |
| JP | 2010035745 | A | 2/2010 | |
| JP | 2010187796 | A | 9/2010 | |
| JP | 5184514 | B2 | 4/2013 | |
| KR | 20010077128 | A | 8/2001 | |
| KR | 20060029567 | A | 4/2006 | |
| KR | 20090006659 | A | 1/2009 | |
| KR | 20090061479 | A1 | 6/2009 | |
| KR | 20100037453 | A | 4/2010 | |
| WO | 0248445 | A1 | 6/2002 | |
| WO | WO-0248445 | A1 * | 6/2002 | ..... D06F 39/083 |
| WO | 2005058124 | A1 | 6/2005 | |
| WO | 2005060813 | A1 | 7/2005 | |
| WO | 2005115216 | A1 | 12/2005 | |
| WO | 2007024491 | A2 | 3/2007 | |
| WO | 2007074024 | A1 | 7/2007 | |
| WO | 2008067898 | A1 | 6/2008 | |
| WO | 2008125482 | A2 | 10/2008 | |
| WO | 2009018903 | A1 | 2/2009 | |
| WO | 2009065696 | A1 | 5/2009 | |
| WO | 2009077266 | A1 | 6/2009 | |
| WO | 2009077279 | A1 | 6/2009 | |
| WO | 2009077280 | A1 | 6/2009 | |
| WO | 2009077283 | A1 | 6/2009 | |
| WO | 2009077286 | A1 | 6/2009 | |
| WO | 2009077290 | A1 | 6/2009 | |
| WO | 2009118308 | A1 | 10/2009 | |
| WO | 2010073185 | A1 | 7/2010 | |

OTHER PUBLICATIONS

German Search Report for DE102017116759.5, dated Jul. 3, 2018.
European Search Report for EP121914675, dated Dec. 5, 2012.
European Search Report for EP11188106, dated Mar. 29, 2012.
European Search Report for EP12188007, dated Aug. 6, 2013.
German Search Report for DE102010061347, dated Jan. 23, 2013.
German Search Report for DE102010061215, dated Feb. 7, 2013.
German Search Report for DE102010061346, dated Sep. 30, 2011.
German Search Report for DE102010061343, dated Jul. 7, 2011.
German Search Report for DE102011053666, dated Oct. 21, 2011.
German Search Report for DE102013103264, dated Jul. 12, 2013.
German Search Report for DE102013103625, dated Jul. 19, 2013.
German Search Report for Counterpart DE102013109125, dated Dec. 9, 2013.
German Search Report for DE102010061342, dated Aug. 19, 2011.
German Search Report for DE1020141017242, dated Apr. 26, 2016.
European Search Report for EP101952380, dated May 19, 2011.
Ishihara et al., JP 11155792 A, English Machine Translation, 1999, pp. 1-14.
German Search Report for Counterpart DE102014101260.7, dated Sep. 18, 2014.

* cited by examiner

ULTRA MICRON FILTER FOR A DISHWASHER

CROSS-REFERENCE TO RELATED APPLICATIONS

This application is a continuation of U.S. patent application Ser. No. 15/479,590, filed Apr. 5, 2017, which is a divisional application of U.S. patent application Ser. No. 13/164,298, filed Jun. 20, 2011, both of which are incorporated herein by reference in their entirety.

BACKGROUND

Contemporary dishwashers of the household-appliance type have a chamber in which utensils are placed to be washed according to an automatic cycle of operation. Water, alone, or in combination with a treating chemistry, forms a wash liquid that is sprayed onto the utensils during the cycle of operation. The wash liquid may be recirculated onto the utensils during the cycle of operation. A filter system may be provided to remove soil particles from the wash liquid.

SUMMARY

Aspects of the disclosure relate to a method of treating utensils in a dishwasher having a treating chamber for receiving utensils, a spray system for spraying wash liquid in the treating chamber, and a recirculating system for recirculating sprayed liquid from the treating chamber to the spray system to treat the utensils according to a cycle of operation.

DESCRIPTION OF EMBODIMENTS

Figure 1:
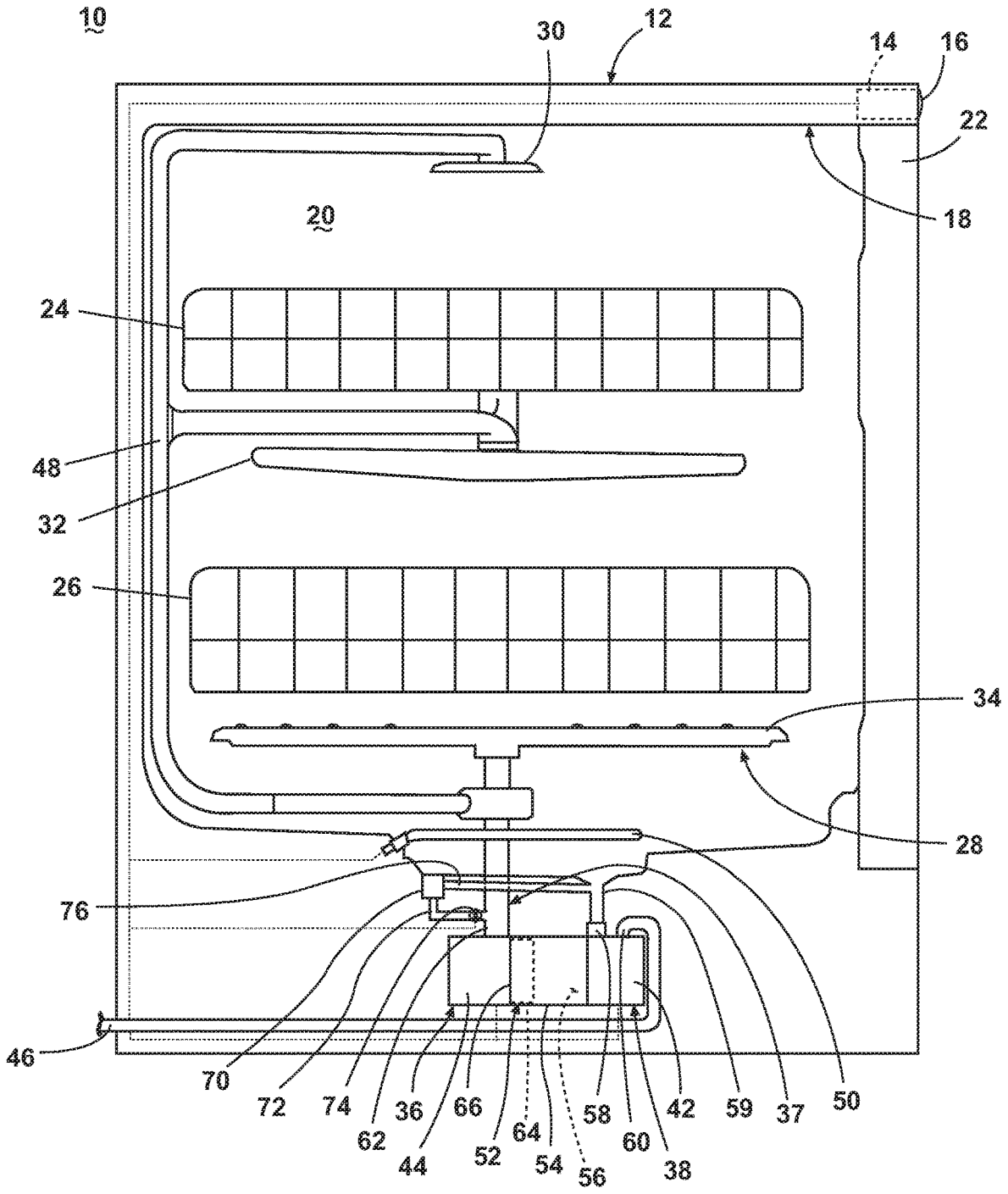
FIG. 1 is a schematic view of a dishwasher according to a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers or drawer-type dishwashers.

A controller 14 may be located within the cabinet 12 and may be operably coupled to various components of the dishwasher 10 to implement one or more cycles of operation. A control panel or user interface 16 may be provided on the dishwasher 10 and coupled to the controller 14. The user interface 16 may include operational controls such as dials, lights, switches, and displays enabling a user to input commands, such as a cycle of operation, to the controller 14 and receive information.

A tub 18 is located within the cabinet 12 and partially defines a treating chamber 20, with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation: dishes, plates, pots, bowls, pans, glassware, and silverware.

A spray system 28 is provided for spraying wash liquid into the treating chamber 20 and is illustrated in the form of an upper sprayer 30, a mid-level sprayer 32, and a lower sprayer 34. The upper sprayer 30 is located above the upper rack 24 and is illustrated as a fixed spray nozzle that sprays liquid downwardly within the treating chamber 20. The mid-level rotatable sprayer 32 and lower rotatable sprayer 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

A liquid recirculation system 36 may recirculate liquid from the treating chamber 20 to the spray system 28. A recirculation circuit 37, which fluidly couples the treating chamber 20 to the spray system 28, may be included in the recirculation system 36. The recirculation circuit 37 may include any structure in the dishwasher 10 that the wash liquid passes through as it travels from the treating chamber 20 to the spray system 28.

A pump assembly 38 may be included in the recirculation system 36 and may be fluidly coupled to the recirculation circuit 37 to pump wash liquid from the treating chamber 20 to the spray system 28. The pump assembly 38 may include both a drain pump 42 and a recirculation pump 44. The drain pump 42 may draw liquid from a lower portion of the tub 18 and pump the liquid out of the dishwasher 10 to a household drain line 46. The recirculation pump 44 may draw liquid from a lower portion of the tub 18 and pump the liquid to the spray system 28 to supply liquid into the treating chamber 20. By way of non-limiting example, the recirculation pump 44 may have a flow rate of 30-50 L/min and output pressures ranging from 150-500 mbar; however, it will be understood that such ranges are exemplary only and an alternative pump having varying attributes may be used.

As illustrated, liquid may be supplied to the mid-level rotatable sprayer 32 and upper sprayer 30 through a supply tube 48, which may be thought of as a portion of the recirculation circuit 37, which extends generally rearward from the recirculation pump 44 and upwardly along a rear wall of the tub 18. While the supply tube 48 ultimately supplies liquid to the mid-level rotatable sprayer 32 and upper sprayer 30, it may fluidly communicate with one or more manifold tubes that directly transport liquid to the mid-level rotatable sprayer 32 and upper sprayer 30. The sprayers 30, 32, 34 spray treating chemistry, including only water, onto the dish racks 24, 26 (and hence any utensils positioned thereon) to effect a recirculation of the liquid from the treating chamber 20 to the liquid spray system 28.

A liquid supply (not shown) may be configured to supply water from a household water supply line to the treating chamber 20.

A heating system having a heater 50 may be located within or near a lower portion of the tub 18 for heating liquid contained therein.

Figure 2:
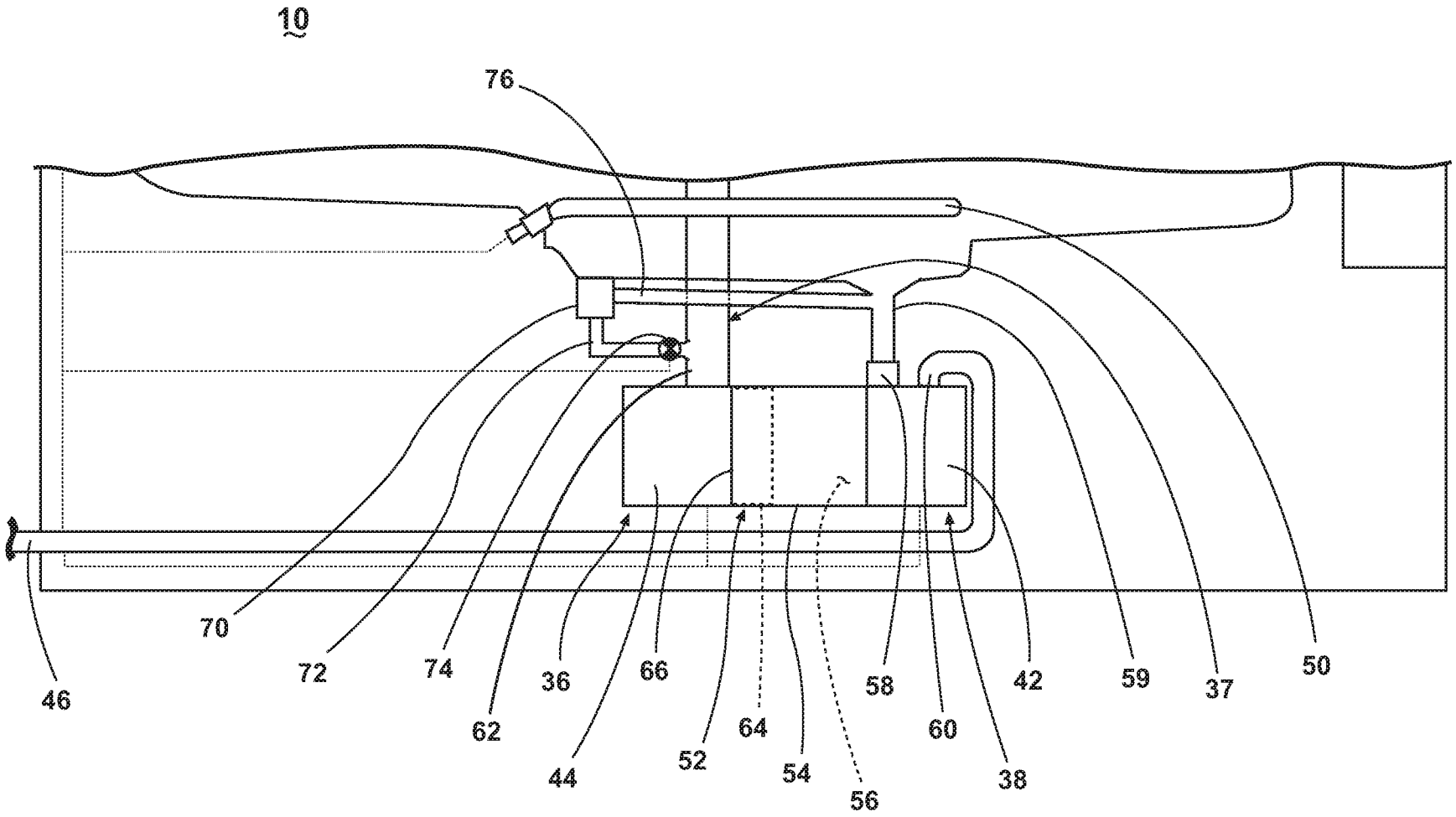
FIG. 2 is an enlarged schematic view of a portion of the dishwasher of FIG. 1.

Referring to FIG. 2, a liquid filter system 52 may be fluidly coupled to the recirculation system 36 and/or the spray system 28 to remove particulates from wash liquid recirculated from the treating chamber 20 to the spray system 28. The liquid filter system 52 may include a housing 54 defining a sump or filter chamber 56. As illustrated, the housing 54 is physically separate from the tub 18 and may provide a mounting structure for the recirculation pump 44 and drain pump 42. The housing 54 has an inlet port 58, which is fluidly coupled to the treating chamber 20 through a conduit 59 and a drain outlet 60, which is fluidly coupled to the drain pump 42 such that the drain pump 42 may effect a supplying of liquid from the sump to the household drain 46. A supply port 62 extends upwardly from the recirculation pump 44 and forms a portion of the recirculation circuit 37 such that the recirculation pump 44 may effect a supplying of the liquid to the sprayers 30, 32, 34.

A passageway (not shown) places the drain outlet 60 in fluid communication with the filter chamber 56. When the drain pump 42 is energized, liquid and soil particles from a lower portion of the tub 18 pass downwardly through the inlet port 58 into the filter chamber 56. The liquid and soil particles then advance from the filter chamber 56 through the passageway without going through a microfilter 64 and advance out the drain outlet 60 to the household drain line 46.

The microfilter 64, shown in phantom, has been illustrated as being located within the housing 54 between the inlet port 58 and an inlet 66 of the recirculation pump 44. In this manner, the microfilter 64 is fluidly coupled to the recirculation system 36 such that all of the recirculated wash liquid passes through the microfilter 64. The microfilter 64 may be any suitable microfilter capable of microfiltering the wash liquid which is recirculated from the treating chamber 20 to the spray system 28. It has been contemplated that the microfilter 64 may be a rotating screen filter. A suitable rotating screen filter is set forth in detail in U.S. patent application Ser. No. 12/643,394, filed Dec. 21, 2009, and titled "Rotating Drum Filter for a Dishwashing Machine," U.S. patent application Ser. No. 12/910,203, filed Oct. 22, 2010, and titled "Rotating Drum Filter for a Dishwashing Machine," U.S. patent application Ser. No. 12/966,420, filed Dec. 13, 2010, and titled "Rotating Drum Filter for a Dishwashing Machine," and U.S. Patent Application 13/164,026 titled "Filter Assembly for a Dishwasher," bearing Applicant's and filed concurrently herewith, all of which are incorporated herein by reference in their entirety. The term "microfiltering" as used herein refers to removing at least particles larger than 150 microns from the wash liquid.

The microfilter 64 is capable of microfiltering all of the wash liquid being recirculated within the dishwasher 10. More specifically, for the disclosed pump flow rate and pressures, and the pressures required for proper operation of the spray system 28, the microfilter 64 is capable of microfiltering the entire flow without negatively impacting system performance. That is, the microfilter 64 is capable of having the full flow of the pump assembly 38 run through it and microfiltering the flow without clogging and without causing a pressure drop that hinders the operation of the spray system 28.

An ultrafilter 70 may be provided to filter the liquid. To reduce the likelihood of clogging, the ultrafilter 70 may be located downstream of the microfilter 64. As illustrated, the ultrafilter 70 is fluidly coupled to the supply port 62 of the recirculation pump 44 and may form a portion of the liquid filtering system 52. More specifically, a diversion circuit 72 may fluidly couple the supply port 62 to an inlet of the ultrafilter 70. A diverter valve 74 may selectively fluidly couple the diversion circuit 72 to the supply port 62 such that the amount of microfiltered liquid supplied to the ultrafilter 70 may be controlled. A return circuit 76 may fluidly couple an output side of the ultrafilter 70 to the recirculation circuit 37. The return circuit 76 may alternatively fluidly couple the output side of the ultrafilter 70 directly to the treating chamber 20. Both the diversion circuit 72 and return circuit 76 may be considered as part of the recirculation circuit 37. Additional valving may be included so that wash liquid is prohibited from entering into the return circuit 76 from the conduit 59.

The ultrafilter 70 may be any suitable filter capable of ultrafiltering the microfiltered wash liquid including by way of non-limiting example, ceramic filters, spiral wound membrane, tubular membranes, and hollow-fiber membranes. The term "ultrafiltering" as used herein refers to removing grit particles from the microfiltered wash liquid. The term "grit" as used in this application may be considered to include particles, which when accumulated on a utensil may be seen or felt by a user on a utensil. This has been found to be particles of 30 microns±10 microns or greater. Thus, the term "ultrafiltering" may refer to removing all particles which may accumulate to be visible or tactile to a user. Such ultrafiltering may include removing particles that are larger than 40 microns, with a satisfactory ultrafiltering including removing particles larger than 20 microns, and an absolute ultrafiltering including removing particles larger than 5 microns. It will be understood that the filtering of particles described herein refers to the filtering of materials anticipated in a dishwasher 10, which may include materials which are fibrous or particulate. Thus, the particle size limits described in the application are meant to identify filtration levels suitable for the application of the inventive concept and are not in any way a limitation on the materials being filtered.

Further, it is contemplated that the ultrafilter 70 may be removable from the dishwasher 10 such that it may be periodically replaced by a user. As illustrated, the ultrafilter 70 may be located such that it may be accessed by a user when the door 22 is opened. Alternatively, it has been contemplated that the ultrafilter 70 may be located in the toe-kick area of the dishwasher 10 where it may also be accessed by a user.

Figure 3:
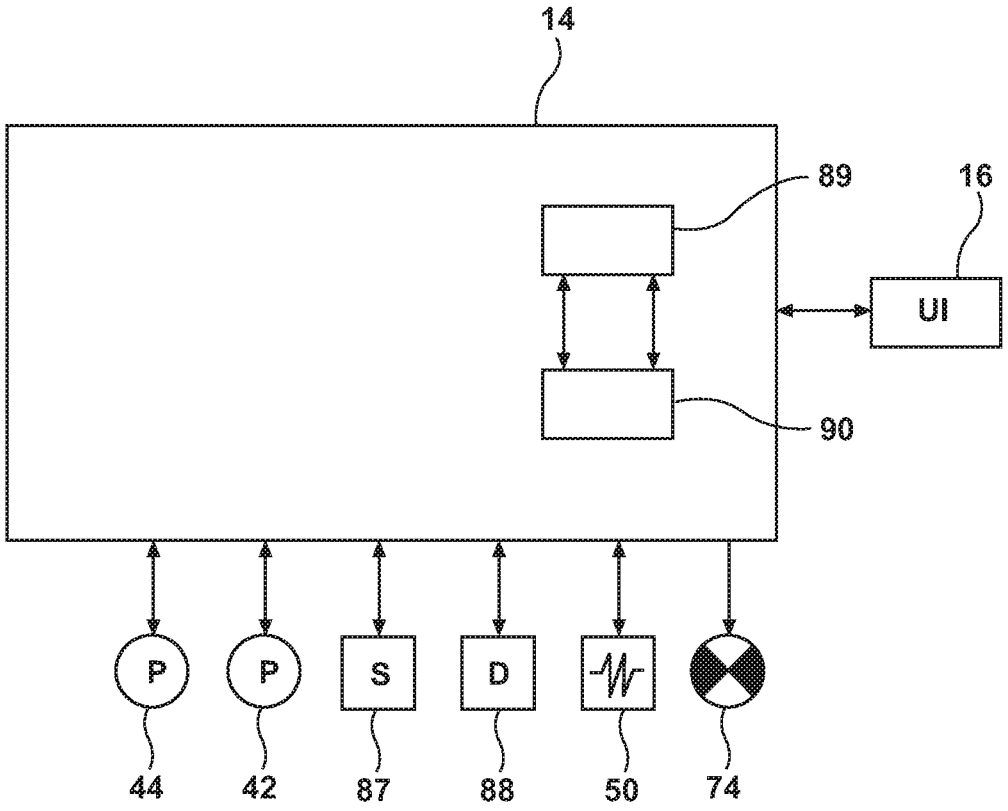
FIG. 3 is a schematic view of a controller of the dishwasher of FIG. 1.

FIG. 3 is a schematic view of the controller 14 of the dishwasher 10 of FIG. 1. As illustrated, the controller 14 may be operably coupled to various components of the dishwasher 10 to implement a cleaning cycle in the treating chamber 20. For example, the controller 14 may be coupled with the recirculation pump 44 for circulation of liquid in the tub 18 and the drain pump 42 for drainage of liquid from the tub 18. The controller 14 may also be coupled with the heater 50 for heating the liquid within the recirculation circuit 37. The controller 14 may also be coupled with the diverter valve 74 to allow liquid to flow through the diversion circuit 72 to the ultrafilter 70. The controller 14 may also receive inputs from one or more other sensors 87, examples of which are known in the art. Non-limiting examples of sensors 87 that may be communicably coupled with the controller include a temperature sensor, a moisture sensor, a door sensor, a detergent and rinse aid presence/type sensor(s). The sensor 87 may also be capable of sensing the presence of the removable ultrafilter 70. The controller 14 may also be coupled to one or more dispenser(s) 88, which may dispense a detergent into the treating chamber 20 during the wash step of the cycle of operation or a rinse aid during the rinse step of the cycle of operation.

The dishwasher 10 may be preprogrammed with a number of different cleaning cycles from which a user may select one cleaning cycle to clean a load of utensils. Examples of cleaning cycles include normal, light/china, heavy/pots and pans, and rinse only. The user interface 16 may be used for selecting a cleaning cycle or the cleaning cycle may alternatively be automatically selected by the controller 14 based on soil levels sensed by the dishwasher 10 to optimize the cleaning performance of the dishwasher 10 for a particular load of utensils.

The controller 14 may be a microprocessor and may be provided with memory 89 and a central processing unit (CPU) 90. The memory 89 may be used for storing control software that may be executed by the CPU 90 in completing a cycle of operation and any additional software. For example, the memory 89 may store one or more preprogrammed cycles of operation. A cycle of operation may include one or more of the following steps: a wash step, a rinse step, and a drying step. The wash step may further include a pre-wash step and a main wash step. The rinse step may also include multiple steps such as one or more additional rinsing steps performed in addition to a final rinse.

During operation, wash liquid, such as water and/or treating chemistry (i.e., water and/or detergents, enzymes, surfactants, and other cleaning or conditioning chemistry) passes from the recirculation pump 44 into the recirculation circuit 37 and then the spray system 28 and then exits the spray system 28 through the sprayers 30-34 and is sprayed into the treating chamber 20. After the sprayed wash liquid contacts the dish racks 24, 26 and any utensils positioned in the treating chamber 20, a mixture of liquid and soil falls onto the bottom wall of the tub 18 and collects in a lower portion of the tub 18 and the filter chamber 56.

The activation of the recirculation pump 44 causes the sprayed wash liquid to advance through the microfilter 64 into the inlet 66 of the recirculation pump 44 where it may be recirculated back through the recirculation circuit 37 to the spray system 28 for subsequent spraying onto any utensils positioned in the treating chamber 20. It is contemplated that all of the sprayed wash liquid is recirculated in this manner and that all of the recirculated wash liquid is microfiltered by the microfilter 64.

While liquid is permitted to pass through the microfilter 64, the microfilter 64 prevents soil particles from moving into the inlet 66 of the recirculation pump 44 and forms a microfiltered wash liquid that is expelled from the recirculation pump 44 through the supply port 62. As the microfiltered wash liquid may contain particles less than 150 microns it is understood that such particles may be deposited back on the utensils in the treating chamber 20 when the liquid is re-sprayed by the spray system 28. Such particles may accumulate to form grit on the utensils.

During operation of the dishwasher 10, the diverter valve 74 may be employed to control the volume of microfiltered liquid supplied from the recirculation pump 44 to the ultrafilter 70. It is contemplated that the ultrafilter 70 may be fluidly coupled to the microfilter 64 such that at least part of the microfiltered liquid passes through the ultrafilter 70. By way of non-limiting example, it is contemplated that at least a portion of microfiltered wash liquid may be fluidly separated from the recirculated microfiltered wash liquid through operation of the diverter valve 74 and that this portion may then be ultrafiltered by the ultrafilter 70 to form an ultrafiltered wash liquid. By way of non-limiting example, the diverter valve 74 may be operated by the controller 14 such that 10-20% of the microfiltered wash liquid expelled by the recirculation pump 44 may be delivered to the ultrafilter 70. Such ultrafiltered wash liquid may then be fluidly combined with the remaining microfiltered recirculating wash liquid in the recirculation circuit 37. As the diverter valve 74 may continuously divert a portion of the recirculating, microfiltered wash liquid stream to the ultrafilter 70 it is conceivable that all of the microfiltered wash liquid may be ultrafiltered should the wash liquid be recirculated long enough.

Alternatively, it has been contemplated that all of the microfiltered wash liquid may be directed to the ultrafilter 70. In such instances, a lower flow rate of microfiltered water may need to be supplied to the ultrafilter 70. If such flow rates are low enough it is contemplated that an additional pump may be needed to expel the ultrafiltered wash liquid from the spray system 28.

While it is desirable from a filtering standpoint to filter all of the microfiltered liquid, the use of the ultrafilter 70 creates the potential for reduced flow rates and reduced pressures that may render other parts of the dishwasher 10 inoperable or may result in those systems operating below acceptable levels. For example, the introduction of the entire flow rate of the recirculation pump 44 to ultrafilter 70 may result in clogging of the ultrafilter 70 or may reduce system pressures or flow rates below what is acceptable for operation of the spray system 28. Thus, the operation contemplates either a continuous diversion of a portion of the recirculating microfiltered wash liquid or the introduction of a lower flow rate of the recirculating microfiltered wash liquid to the ultrafilter 70.

It is contemplated that the ultrafiltering of the sprayed liquid may occur during at least one phase of the cycle of operation including during at least one of the wash phase and the rinse phase. Further, because contemporary dishwashers may have both first and second rinses it is contemplated that the ultrafiltering may occur in either or both portions of the rinse phase. By way of non-limiting example, the ultrafiltering may occur during the final portion of the rinse phase such that a fine filtration of the sprayed liquid occurs. During the cycle of operation, the final rinse tends to have the least amount of grit because most of the soils have been drained away in earlier portions of the cycle of operation. It is also the last liquid to be applied to the dishes and thus grit is not redeposited on the utensils before the end of the cycle, which results in a satisfactory cleaning result for the user. Thus, the most benefit may be achieved by ultrafiltering during the final portion of the rinse phase.

It is contemplated that a soil level in the wash liquid may be sensed and that the ultrafiltering may occur only when the soil level is below a predetermined threshold, as determined by the controller 14, such that the wash liquid will not prematurely clog the ultrafilter 70. It is contemplated that the ultrafiltering may be used to reduce water consumption during the cycle of operation. For example, the ultrafiltering may occur during the wash phase such that the wash liquid may be filtered to the point where it may be reused for at least one of the first and second rinses. Alternatively, water consumption may be lowered if the ultrafiltering occurs during the first rinse and the liquid is reused for the second rinse.

It is also contemplated that the controller 14 may receive a signal from the sensor 87, which may indicate the presence of the ultrafilter 70 and that the controller 14 may determine from the signal that the ultrafilter 70 is present in the dishwasher 10. If the controller 14 determines that the ultrafilter 70 is present, then the dishwasher 10 may be operated as described above to allow for ultrafiltering of the wash liquid. If the controller 14 determines that the ultrafilter 70 has not been installed, the controller 14 may close the diverter 74 or, alternatively, may not open the diverter valve 74 and may prohibit wash liquid from entering into the diversion circuit 72.

Figure 4:
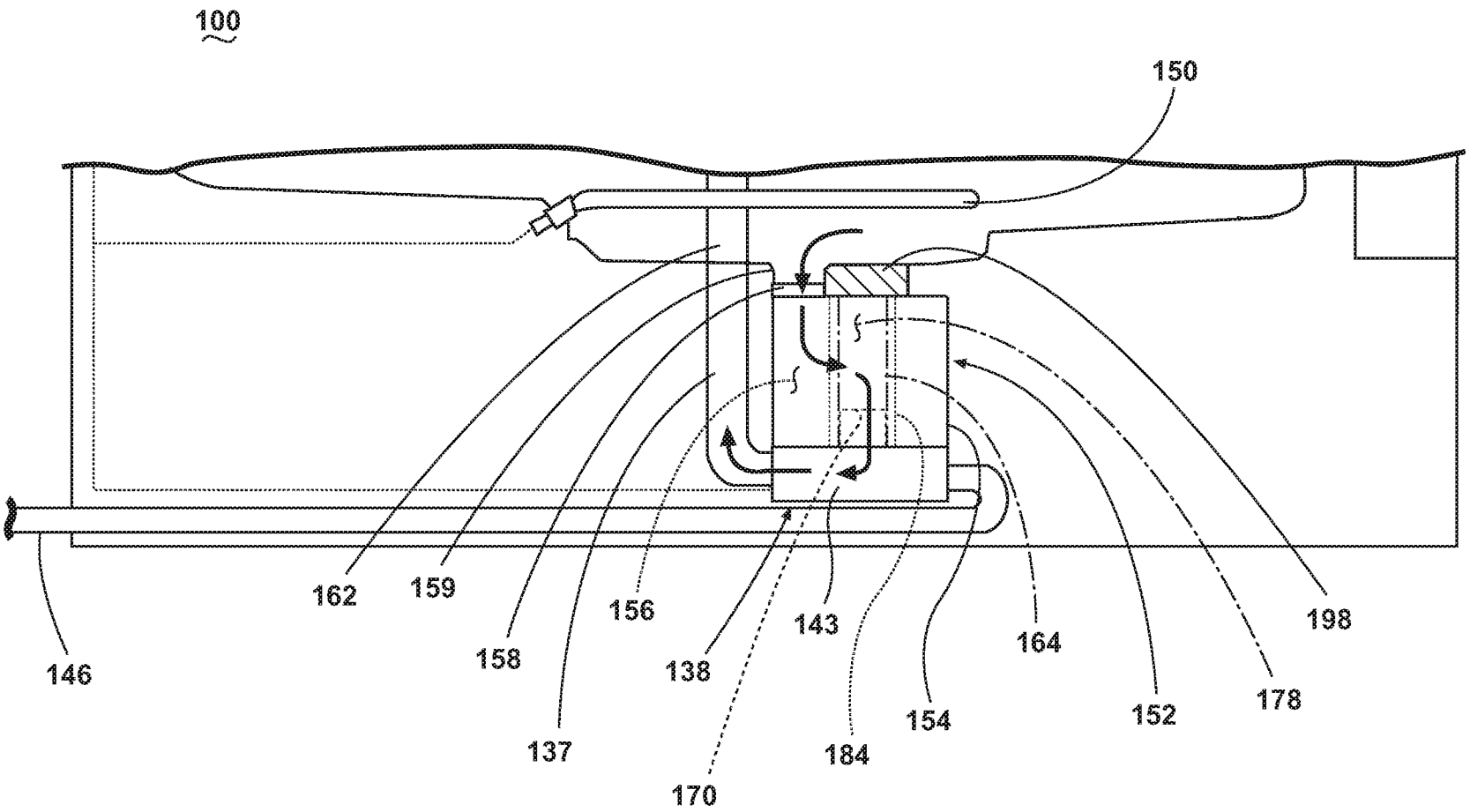
FIG. 4 is a schematic view of a portion of a dishwasher according to a second embodiment of the invention.

FIG. 4 illustrates a portion of a dishwasher 100 having a pump assembly 138 and filtering system 152 according to a second embodiment of the invention. The second embodiment is similar to the first embodiment; therefore, like parts will be identified with like numerals increased by 100, with it being understood that the description of the like parts of the first embodiment applies to the second embodiment, unless otherwise noted.

One difference between the second embodiment and the first embodiment is that the recirculation system has been illustrated as including a pump assembly 138, which includes a single pump 143 configured to selectively supply liquid to either the recirculation circuit 137 and the spray system 128 or the drain line 146, such as by rotating the pump 143 in opposite directions. Alternatively, it has been contemplated that a suitable valve system (not shown) may be provided to selectively supply the liquid from the pump 143 to either the recirculation circuit 137 and spray system 128 or the drain line 146.

Another difference between the second embodiment and the first embodiment is that the liquid filtering system 152 is oriented vertically such that microfilter 164 is oriented vertically within a vertical housing 154. It is contemplated that the microfilter 164 may be a cylindrical screen filter, which may extend from an upper end of the housing 154 to the recirculation pump 144.

It has been contemplated that the microfilter 164 may be a rotating screen filter such that wash liquid passing through the recirculation circuit 137 passes through the rotating microfilter 164. Two optional artificial boundaries or flow diverters 184 are illustrated as being positioned in the filter chamber 156 externally of the microfilter 164 and may cause an increased shear force to be applied to the microfilter 164 to aid in its cleaning. Suitable rotating screen filters and flow diverters are set forth in detail in U.S. patent application Ser. No. 12/643,394, filed Dec. 21, 2009, and titled "Rotating Drum Filter for a Dishwashing Machine," U.S. patent application Ser. No. 12/910,203, filed Oct. 22, 2010, and titled "Rotating Drum Filter for a Dishwashing Machine," U.S. patent application Ser. No. 12/966,420, filed Dec. 13, 2010, and titled "Rotating Drum Filter for a Dishwashing Machine," and U.S. Patent Application 13/164,026 titled "Filter Assembly for a Dishwasher," bearing Applicant's and filed concurrently herewith, all of which are incorporated herein by reference in their entirety. As illustrated, the rotating microfilter 164 may divide the filter chamber 156 into an exterior and an interior. As wash liquid and removed soil particles enter the filter chamber 156 through the inlet port 158, a mixture of liquid and soil particles is collected in the filter chamber 156 in an exterior or a region external to the microfilter 164. Because the microfilter 164 permits liquid to pass into the interior 178, a volume of filtered liquid is formed in the interior 178. The interior 178 fluidly couples to an inlet of the pump 143.

It has alternatively been contemplated that the microfilter 164 may be stationary while the flow diverters 184 rotate as set forth in detail in U.S. patent application Ser. No. 13/108,026, filed May 16, 2011, and titled "Dishwasher with Filter Assembly," which is incorporated herein by reference in its entirety. Regardless of whether the microfilter 164 rotates or any optional diverters rotate, the microfilter 164 may be considered to be capable of at least removing particles larger than 150 microns from the recirculated wash liquid.

Another difference between the second embodiment and the first embodiment is that the ultrafilter 170 is located within the interior 178 such that wash liquid passing through the rotating microfilter 164 into the interior 178, then passes through the ultrafilter 170, before entering the pump 143. Further, a removable cover 198 has been illustrated as being flush with the bottom wall of the tub 118 and being operably coupled to the housing 154 such that it may seal the housing 154. Thus, the inlet 158 is the only liquid inlet into the housing 154. A user may remove the cover 198 to access either the microfilter 164 or the ultrafilter 170. It has been contemplated that the microfilter 164 may be removably mounted within the housing 154 such that once the cover 198 has been removed a user may remove the microfilter 164 to clean it. Further, it is contemplated that the ultrafilter 170 may be removably mounted within the housing 154 such that a user may remove the ultrafilter 170 to replace it. The user may then replace the ultrafilter 170, the microfilter 164, and the cover 198 to again achieve a sealed filter chamber 156.

The second embodiment operates much the same way as the first embodiment. The remainder of this discussion assumes that the microfilter 164 is rotatably coupled with a motor of the pump 143. During operation of the dishwasher 100, liquid is recirculated and sprayed by the spray system 128 into the treating chamber 120. Activation of the pump 143 causes the liquid to be recirculated and the microfilter 164 to rotate. Wash liquid that enters the housing 154 may be directed through the rotating microfilter 164 into the interior 178, where it may then travel through the ultrafilter 170 and back into the recirculation circuit 137 as illustrated by the arrows. The liquid is microfiltered as it passes through the rotating screen microfilter 164 into the interior 178. The microfiltered liquid then advances through the ultrafilter 170 before it enters the pump 143 and advances through the supply port 162 into the recirculation circuit 137. When the ultrafiltered wash liquid is delivered from the recirculation circuit 137 to the spray system 128, it is expelled from the spray system 128 onto any utensils positioned in the treating chamber 120. In this manner, all of the wash liquid is both microfiltered and ultrafiltered.

There are a plurality of advantages of the present disclosure arising from the various features of the apparatuses and methods described herein. For example, the embodiments of the apparatus described above allow for enhanced filtration such that soil is filtered from the wash liquid and not re-deposited on utensils in the treating chamber. More specifically, the ultrafilter is capable of filtering the microfiltered liquid such that is removes any particles that may pass through the microfilter. Such ultrafiltration may be advantageously used so that such particles are not deposited onto the utensils and no grit forms on the utensils. Further, the embodiments of the apparatus described above allow for the microfilter to remove larger particles from the wash liquid such that the ultrafilter will not prematurely clog. This allows for the ultrafilter to be used for a longer time before replacement is needed and maximizes the performance of the dishwasher.

Further, because the ultrafilter is able to provide a finer filter of the wash liquid the liquid may be reused in subsequent portions of the cycle of operation without additional charges of water needing to be added to the dishwasher. For example, contemporary dishwashers may require three charges of water for a typical cycle of operation with these fills coinciding with a wash step, an intermediate rinse, and a final rinse. By way of non-limiting example, the above embodiments may allow the dishwasher to eliminate one of the rinse fills. Alternatively, it has been contemplated that the rinse phase with the ultrafiltered wash liquid may require less water exchanges or uses less water than a contemporary dishwasher because the wash liquid may be finely filtered and reused in various steps. Thus, the invention may operate to save water provided to the dishwasher during the cycle of operation.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of treating utensils in a dishwasher having a treating chamber for receiving utensils, a spray system for spraying wash liquid in the treating chamber, and a recirculating system for recirculating sprayed liquid from the treating chamber to the spray system to treat the utensils according to a cycle of operation, the method comprising:

spraying wash liquid from the spray system into the treating chamber;

recirculating, via a recirculation pump, the sprayed wash liquid from the treating chamber back to the spray system for subsequent spraying;

prior to the subsequent spraying, passing the sprayed wash liquid through a microfilter to let pass particles of a size smaller than 150 microns to form a microfiltered wash liquid where the microfilter includes a hollow rotary filter coupled at a first end to an impeller of the recirculation pump and wherein the sprayed wash liquid is drawn through the hollow rotary filter, into the recirculation pump and expelled through an outlet fluidly coupled with the spray system; and prior to the subsequent spraying, ultrafiltering at least a portion of the microfiltered wash liquid to remove particles larger than 40 microns to form an ultrafiltered wash liquid comprising only particles 40 microns or smaller and without grit.

2. The method of claim 1 wherein a full flow of the recirculation pump is microfiltered such that all of the sprayed wash liquid is microfiltered.

3. The method of claim 2 wherein all of the microfiltered wash liquid is ultrafiltered.

4. The method of claim 1, further comprising selectively diverting a portion of microfiltered wash liquid and ultafiltering only the selectively diverted portion.

5. The method of claim 4, further comprising passing the ultrafiltered wash liquid back through the microfilter prior to the subsequent spraying.

6. The method of claim 1 wherein the ultrafiltering occurs during at least one phase of the cycle of operation.

7. The method of claim 6 wherein the at least one phase is at least one of a wash phase or a rinse phase.

8. The method of claim 1 wherein the ultrafiltering includes removing particles larger than 20 microns to form the ultrafiltered wash liquid comprising only particles 20 microns or smaller.

9. The method of claim 8 wherein the ultrafiltering includes removing particles larger than 5 microns to form the ultrafiltered wash liquid comprising only particles 5 microns or smaller.

* * * * *